US008640343B2

(12) United States Patent
Rayner

(10) Patent No.: US 8,640,343 B2
(45) Date of Patent: Feb. 4, 2014

(54) CUTTING APPARATUS

(75) Inventor: William Rayner, Annandale (AU)

(73) Assignee: Rayner Design Pty Ltd, Annandale (AU)

( * ) Notice: Subject to any disclaimer, the term of this patent is extended or adjusted under 35 U.S.C. 154(b) by 0 days.

(21) Appl. No.: 13/392,843

(22) PCT Filed: Aug. 26, 2010

(86) PCT No.: PCT/AU2010/001101

§ 371 (c)(1),
(2), (4) Date: Feb. 27, 2012

(87) PCT Pub. No.: WO2011/022775

PCT Pub. Date: Mar. 3, 2011

(65) Prior Publication Data

US 2012/0151780 A1 Jun. 21, 2012

(30) Foreign Application Priority Data

Aug. 27, 2009 (AU) ..... 2009904101

(51) Int. Cl.
*B26D 1/143* (2006.01)
*B26D 1/15* (2006.01)

(52) U.S. Cl.
USPC ..... 30/240; 30/263; 30/264

(58) Field of Classification Search
USPC ..... 30/240, 263, 264
See application file for complete search history.

(56) References Cited

U.S. PATENT DOCUMENTS 576,610 A * 2/1897 Pohlsen ..... 30/264
1,649,957 A * 11/1927 Holtzman ..... 30/139
1,756,362 A * 4/1930 Junkers ..... 30/263
1,796,463 A * 3/1931 Voigt et al. ..... 30/240
1,876,075 A * 9/1932 Reichert, Jr. et al. ..... 30/240
2,042,097 A * 5/1936 Havanas ..... 30/264
2,701,911 A * 2/1955 Maescher ..... 30/240
3,189,997 A * 6/1965 Mount ..... 30/228
3,325,896 A 6/1967 D'Angelo et al.
3,460,251 A 8/1969 Somervell et al.
3,815,231 A * 6/1974 Greenberg ..... 30/228
3,906,629 A * 9/1975 Fuchs, Jr. ..... 30/240

(Continued)

FOREIGN PATENT DOCUMENTS

JP 1-65896 U 4/1989
JP 2004-42191 A 2/2004
WO WO 2008/014546 A1 * 2/2008

*Primary Examiner* — Hwei C Payer
(74) *Attorney, Agent, or Firm* — Kilpatrick Townsend & Stockton LLP

(57) ABSTRACT

Cutting apparatus for cutting material, the apparatus comprising two blades arranged so that in use together they can effect a cutting operation in a cutting region therebetween, the blades being mounted relative to one another so that they are urged together in the cutting region as a result of a cutting force initiated by the cutting operation. In one embodiment at least one of the blades is mounted for pivotal movement about a pivot axis so that during the cutting operation the cutting or shearing force generated causes the blade to be pivotally urged towards the other blade. In another embodiment one blade is a rotatable cutter blade and the other blade is a further cutter blade which is adapted to cooperate together to perform the cutting operation in a cutting region, the further cutting blade being mounted so as to be urged towards the rotatable blade as a result of the cutting or shearing forces generated during the cutting operation.

9 Claims, 4 Drawing Sheets

(56) References Cited

U.S. PATENT DOCUMENTS

| | | | | | |
|---|---|---|---|---|---|
| 4,275,500 | A * | 6/1981 | Speer et al. | ..... | 30/240 |
| 4,381,605 | A * | 5/1983 | Holm | ..... | 30/240 |
| 4,574,480 | A * | 3/1986 | Dunn | ..... | 30/240 |
| 4,669,190 | A * | 6/1987 | Innami et al. | ..... | 30/273 |
| 4,693,004 | A * | 9/1987 | Plana | ..... | 30/265 |
| 8,220,162 | B2 * | 7/2012 | Rayner | ..... | 30/240 |
| 8,316,548 | B2 * | 11/2012 | Dreher | ..... | 30/228 |

* cited by examiner

CUTTING APPARATUS

INTRODUCTION

This invention relates generally to cutting apparatus suitable for but not limited to cutting flexible sheet material such as for example paper, cardboard, fabric, plastics and the like.

BACKGROUND

One form of cutting device is described in international patent specification WO 2008/014546. The contents of that document are incorporated herein by way of cross-reference. The device is a manually operable cutter device for cutting flexible sheet material and comprises a cutter body which is movable over a work surface on which the flexible sheet being cut can rest. The device includes a cutting blade assembly operatively mounted to the cutter body and including a first rotatable cutter blade having a peripheral edge portion and a second cutter blade which is mounted in a substantially fixed position relative to the rotatable blade, the blade being adapted to cooperate together to provide a cutting zone in which sheet material can be cut. The rotatable cutting blade is mounted for rotation about an axis which extends generally laterally with respect to a normal feed direction of the sheet material to the cutting zone and the direction of rotation of the peripheral edge portion through the cutting zone is in the normal feed direction. The tangential peripheral speed of the rotating cutter blade in the cutting zone is not less than the speed of the feed of sheet material to the cutting zone.

Whilst this device provides significant advantages over conventional cutters it can encounter problems in particular when the sheet material is relatively thick because the second blade has a relatively small and substantially stationary contact zone which tends to get hot if speed and force are high. The heating can cause local welding or galling resulting in a gritty feel and deterioration of the cutting edge. Conventional scissors can also encounter problems where they are required to cut sheeting of different thicknesses. The thicker material increases the operating force during opening and closing of the blades.

SUMMARY OF THE INVENTION

In a first aspect there is disclosed cutting apparatus for cutting material, the apparatus comprising first and second blades arranged so that in use together they can effect a cutting operation in a cutting region therebetween. The blades are mounted relative to one another so that they are at least in part urged together in the cutting region as a result of a cutting or shearing force generated by the cutting operation.

In certain embodiments one of the blades is mounted for pivotal or flexing movement about an axis so that during the cutting operation the cutting or shearing force generated produces a force which urges the blades together. In another arrangement the blades may be urged together by utilising transmission torque. The cutting apparatus may, in certain embodiments include two arms pivotally connected together to form a scissor-like configuration, the first of the cutting blades being secured to or integral with an edge of a first one of the arms and the second cutting blade being pivotally mounted to a second of the arms so that during a cutting operation the cutting or shearing force generated produces a force which urges the first blade and the second blade together.

In certain embodiments the second arm includes a groove therein for receiving a section of the second blade so as to form a pivot region for the second blade. The groove may for example be elongate in the general axial direction of the second arm and may be adapted to receive therein an edge of the second blade opposite the cutting edge. In certain embodiments the second cutting blade may be operatively mounted to the second arm by means of a cooperating lug and slot which retains the edge within the groove. In certain embodiments the second blade is mounted to the second arm so as to provide a pre-load force thereto to urge it into engagement with the first blade.

In certain embodiments the cutting apparatus the first blade may be in the form of a rotatable cutter blade, the first and second blades being adapted to cooperate together to perform the cutting operation in a cutting region. The second cutting blade may be mounted so as to urge it towards the rotatable blade as a result of the cutting or shearing forces generated during the cutting operation. The second blade may, in certain embodiments include a cutting edge in the cutting region and a mounting arm which is operatively mounted in spaced relation to the cutting edge at a pivot region so that the cutting force generated produces a force on the mounting arm about the pivot region so as to urge the second blade cutting edge and the rotating blade together.

In certain embodiments the cutting apparatus may comprise a cutter body which is movable over a work surface the rotatable cutter blade having a peripheral edge portion and the second cutter blade adapted to cooperate together to provide the cutting region in which sheet material can be cut, the rotatable cutting blade being mounted for rotation about an axis which extends generally laterally with respect to a normal feed direction of the sheet material to the cutting region and the direction of rotation of the peripheral edge portion through the cutting region is in the normal feed direction. The tangential peripheral speed of the rotating cutter blade in the cutting region in certain embodiments is not less than the speed of the feed of sheet material to the cutting region. It is to be understood however, that this latter mentioned feature is not to be considered a limitation. The arrangement by which the blades are urged together is applicable to other cutter assemblies.

A drive may be provided for causing rotation of the rotatable cutter blade. In certain embodiments the drive includes a drive wheel which is operatively mounted to the cutter body and adapted to rotate as the cutter body travels over the work surface in a direction opposite to the feed direction. The drive wheel may be operatively coupled to the rotatable cutter blade via a transmission which causes the wheel and the rotatable cutter blade to rotate in the same direction as the cutter body travels over the work surface. The transmission may for example, include a gear train.

In certain embodiments the cutter body may include a housing having support wheels operatively mounted thereto at least one of the ground engaging wheels providing for the drive wheel. At least one of the support wheels may be disposed forwardly of the rotatable cutter blade with respect to the normal direction of travel of the device when cutting.

Notwithstanding any other forms which may fall within the scope of the apparatus as set forth in the Summary, specific embodiments will now be described by way of example and with reference to the accompanying drawings in which.

DESCRIPTION OF SPECIFIC EMBODIMENTS

Figure 1:
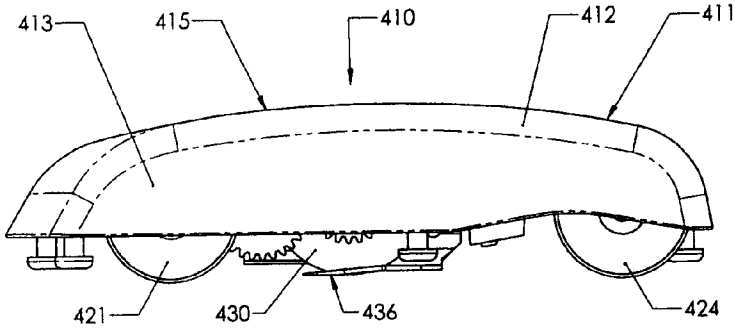
FIG. 1 is a schematic side view of a cutting apparatus according to one embodiment.
Figure 2:
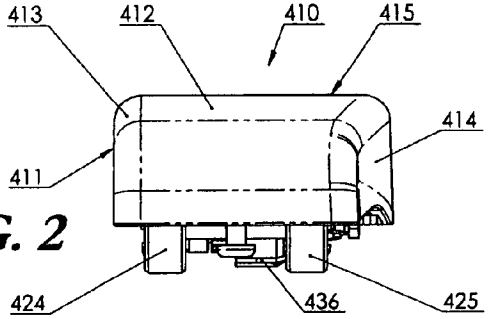
FIG. 2 is an end view of the apparatus as shown in FIG. 1.

Referring to FIGS. 1 to 9 there is shown cutting apparatus generally indicated at 410 which is particularly suitable for cutting flexible sheet materials such as for example paper, cardboard, plastics sheets or the like. The device 410 includes a main body 411 in the form of a unitary housing 412 which can house the internal parts and can be comfortably held in one hand. The housing 412 includes spaced apart side wall sections 413 and 414 and a top wall section 415. The device further comprises drive wheels 420 and 421 operatively connected to the main body 412 via an axle 423 secured to the housing 412 at axle mounts 426 and 427. The drive wheels 420 and 421 are adapted to roll on the flexible sheet or the work surface on which the material being cut is placed. The work surface may be in the form of a generally flat surface such as an inclined or horizontal table or other structure. Stabilising wheels 424 and 425 are provided which ensure the cutter device remains planar with respect to the table during use. The wheels 424, 425 are mounted on an axle 431 secured to the housing at axle mounts 432 and 433. One or more of the stabilising wheels may also perform as drive wheels, particularly in the straight cutting version of the device.

Figure 3:
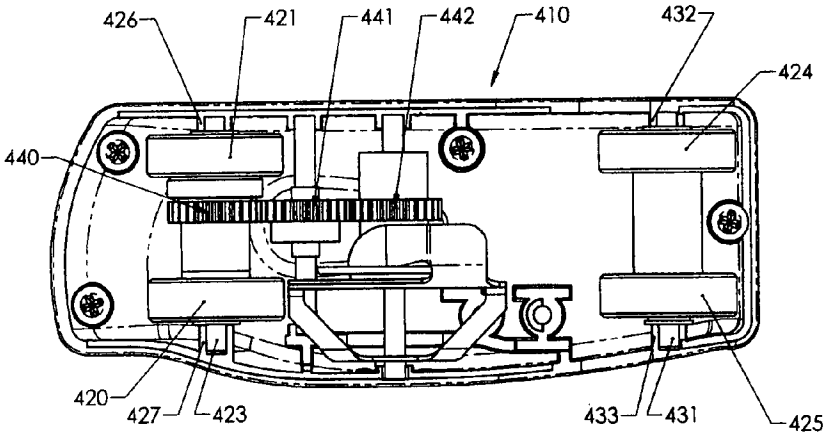
FIG. 3 is an underside view of the apparatus as shown in FIGS. 1 and 2.
Figure 4:
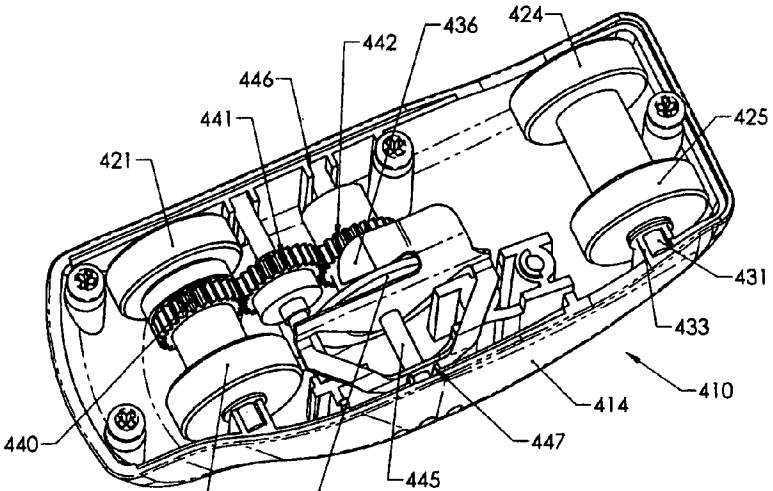
FIG. 4 is an isometric underside view of the apparatus shown in FIGS. 1 to 3.
Figure 6:
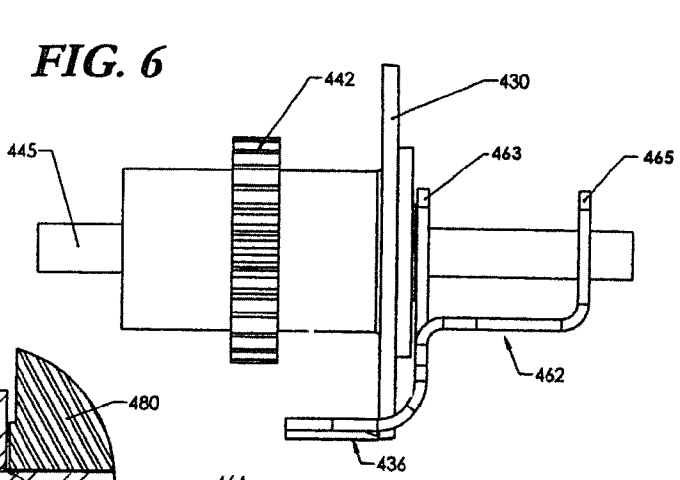
FIG. 6 is a side view of part of the apparatus shown in FIGS. 1 to 5.
Figure 5:
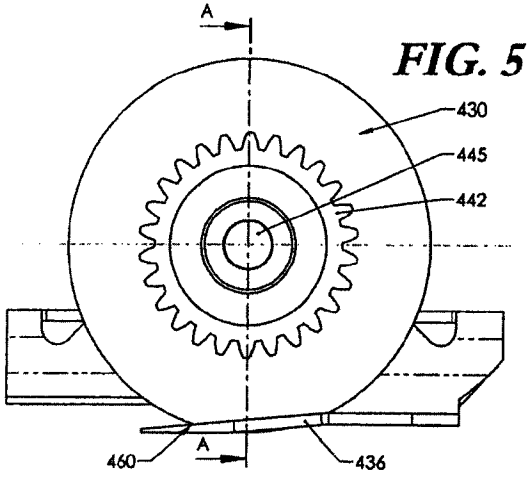
FIG. 5 is a detail of part of the apparatus shown in FIGS. 1 to 4.

A first rotatable cutter disc or blade 430 is supported on axle 445 connected to the housing 412 at axle mounts 446 and 447 so that its axis of rotation is parallel to, or within approximately 15° of being parallel to the drive wheel axis, with its lower edge close to but not touching the work table. As best illustrated in FIGS. 3 and 4 the axle mounts 426, 427, 432, 433, 446 and 447 are in the form of spaced apart channels which receive the ends of the respective axles therein. Gears 440, 441 and 442 causes the drive wheel to rotate the cutter disc 430, in the same rotational direction as the drive wheel and in one example embodiment, with a peripheral speed of the cutter disc which is greater than or equal to that of the drive wheel. This however is not necessary but desirable. Blade 430 is mounted on a hub part 480 which has a spigot part 482 to which gear 442 is mounted. A second blade 436 is operatively mounted to the housing 412 via mounting zones 471 and 472 on axle 445 with a cutting edge 437 (FIG. 9) substantially horizontal or tilted down slightly in the forward direction as shown and positioned close to the cutting table and against the cutting edge of the cutter disc 430 defining a cutting zone 460 therebetween.

Figure 8:
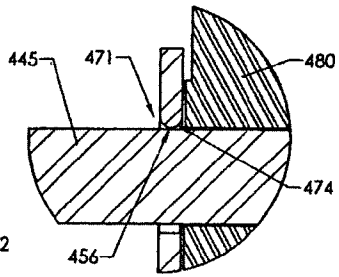
FIG. 8 is a detail of that part of the apparatus shown in circle B on FIG. 7.
Figure 9:
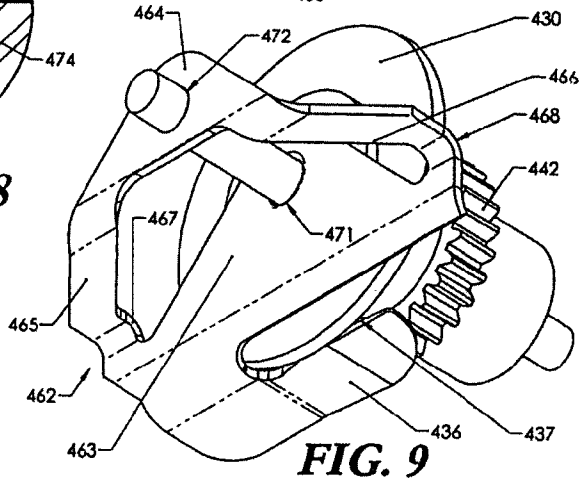
FIG. 9 is an isometric view of part of the apparatus shown in FIGS. 1 to 8.

The second blade 436 includes a mounting section 462 which comprises a first part 463 and a second part 464 which are secured together or integral with one another. The second part 464 comprises two connecting limbs 465 and 466 which are secured to the first part 463 at junction regions 467 and 468. The junction regions are spring loaded so that the blade 436 is urged by a preload biasing force towards blade 430. Each part 463 and 464 has a mounting zone 471 and 472 associated therewith. The mounting zones 471 and 472 include apertures through which the axle 445 passes. The apertures have cross-sectional dimension which is larger than that of the axle 445 thereby permitting limited movement of the second blade 436 about pivot point 456. As best seen in FIG. 8 the at least part of the edge 474 of mounting zone 471 may be curved to provide for the pivot point 456. This however is not essential and may simply be roughly punched for example because movement is negligible. As is apparent from FIG. 7 the pivot point 456 is offset in the axial direction from the cut region. Mounting zone 472 assists in aligning the second blade relative to the first blade.

Figure 13:
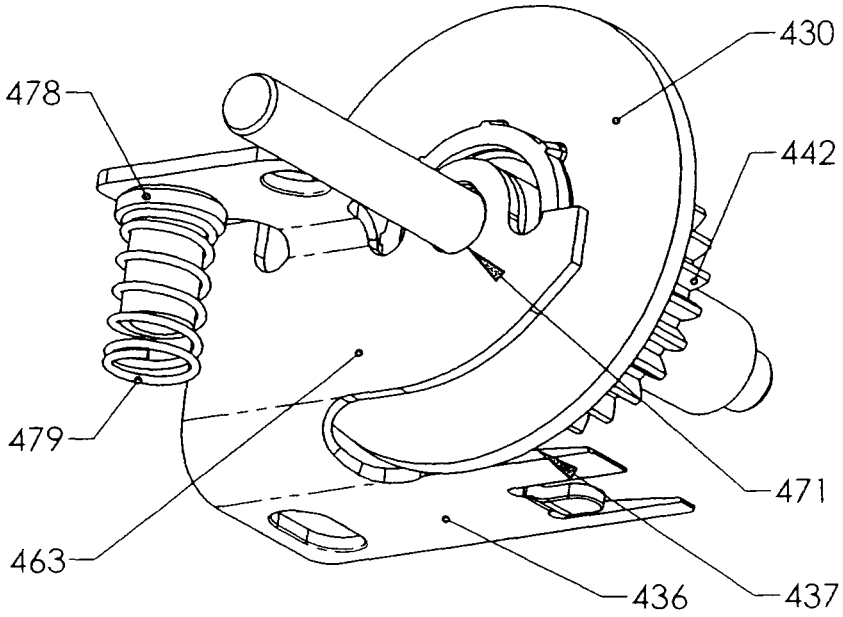
FIG. 13 is an isometric view of part of the apparatus according to a further embodiment

Another arrangement is shown in FIG. 13. In this arrangement the second part 464 of the mounting section 462 is replaced with a spring 479 supported on guide 478 which is secured to or integral with the part 463 of the mounting section 462. The free end of the spring 479 bears against part of the cutter body. The spring 479 provides for a preload biasing force on blade 436 towards blade 430.

In operation the cutter body 412 is presented to the edge of the material being cut and the material lifted so that the second blade 436 passes under it. A lifter blade (not shown) may be provided to assist positioning of the paper and blade. The cutter body is then pushed further with a slight downward force to provide traction for the drive wheels. The gears 440, 441 and 442 drive the cutter disc 430 at a peripheral speed equal to or greater than the forward speed of the cutter body but in the opposite direction (the same rotational direction as the drive wheel). The cutting disc 430 thus slides backwards against the material, tending to draw the material into the cutting blades at the point of shear. During the cutting operation the cutting or shear force generated at the cutting zone 460 causes the second blade 436 to pivot about point 456 so as to urge it towards the rotating blade 430.

In one example embodiment the cutting performance of the apparatus is effective because the sum of the paper driving forces exceeds the sheet material stalling forces. The sheet material driving forces are the sum of the cutter disc traction force and the sheet material compression force. The sheet material stalling force is the sum of the second blade sliding friction (with respect to the sheet material) and the component of the shearing force parallel to the travel direction of the sheet material. Preferably, operation is achieved by maximising the driving and minimising the stalling forces as follows. Minimising the cutter disc slip velocity maximises the coefficient of friction (which is lower at higher sliding velocities in most cases—hence the need for antilock braking systems in motor vehicles). The cutter disc friction can be maximised through material selection of the substantially cylindrical surface next to the cutting edge. The drive wheel to sheet material friction can be maximised through material selection and placement of non-driving wheels and skid pads as far as possible from the point of application of the user's drive force. The sheet material entry slot gap is minimised, to substantially prevent sheet material buckling under compression to ensure transmission to feed force and reduce friction. The static and dynamic coefficients of friction of the fixed blade material surface may be minimised as is the angle between the cutter disc and second blade at the region of shear, thereby minimising the component of the shearing force parallel to the sheet material travel direction. The friction coefficient of the lower surface of the sheet material with respect to the upper surface can be minimised by inverting the sheet material if necessary.

Figure 7:
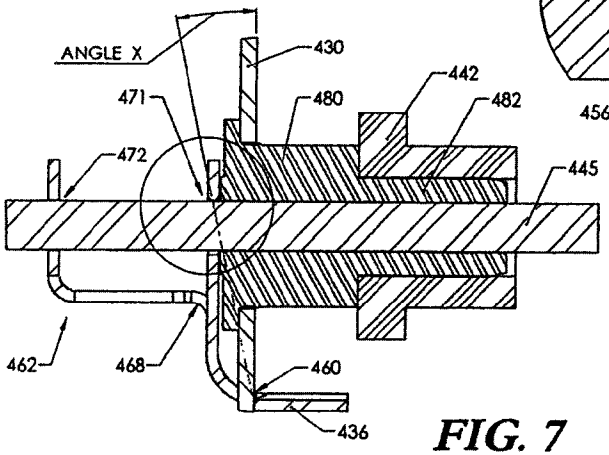
FIG. 7 is a sectional side elevation taken along the line A-A in FIG. 5.

The second blade is configured so that the shearing force generates a moment about the pivot axis which is balanced by a contact force between the blades which holds them together. The introduction of the material being cut into the cutting region produces a downwards force on the second blade thereby causing it to be urged towards the other blade. The thicker the material the greater the force produced. The tilt angle X as shown in FIG. 7 determines how hard the blades push together in proportion to the shearing force. The arrangement has been found most advantageous for the cutter as the fixed blade has a small and stationary contact zone which tends to get hot if speed and force are high. The heating may cause local galling resulting in erratic operation and deterioration of the cutting edges, particularly when quickly rolling the cutter into position while not cutting.

The forces required to shear the paper or other sheet material are used to pull the blades together, so that only a small blade preload is required. This means that the friction is very low running the cutter backwards, slightly higher when cutting light paper, and only increases significantly when cutting heavier paper/card.

Figure 10:
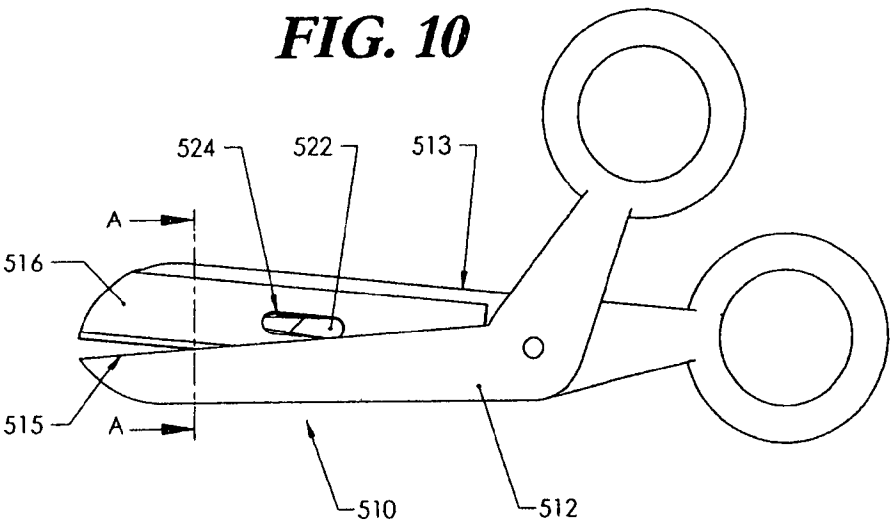
FIG. 10 is a side elevation of cutting apparatus according to another embodiment.
Figure 11:
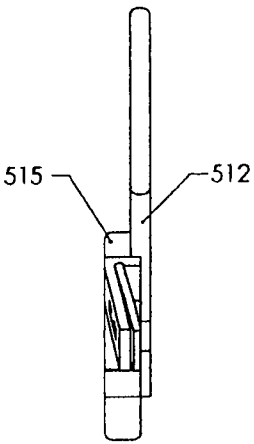
FIG. 11 is an end view of the apparatus shown in FIG. 10.
Figure 12:
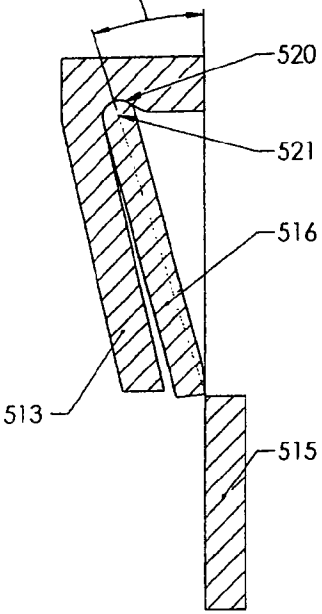
FIG. 12 is a sectional view taken along the line A-A in FIG. 10.

Referring to FIGS. 10 to 12 there is illustrated cutting apparatus 510 including two arms 512 and 513 pivotally connected together to form a scissor-like configuration, a first cutting blade 515 being secured to or integral with an edge of a first one of the arms and a second cutting blade 516 being pivotally mounted to a second of the arms so that during a cutting operation the cutting force causes pivotal movement of the second towards the first blade.

The second arm 513 includes a groove 520 therein for receiving a section of the second blade therein so as to form a pivot region 521 for the second blade. The groove is elongate in the general axial direction of the second arm and is adapted to receive therein an edge of the second blade opposite the cutting edge. The second cutting blade is operatively mounted to the second arm by means of a cooperating lug 522 and slot 524 which retains the edge within the groove. The second blade is mounted to the second arm so as to provide a pre-cutting force thereto to urge it into engagement with the first blade.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

Throughout this specification and the claims which follow, unless the context requires otherwise, the word "comprise", and variations such as "comprises" or "comprising", will be understood to imply the inclusion of a stated integer or step or group of integers or steps but not the exclusion of any other integer or step or group of integers or steps.

Finally, it is to be understood that various alterations, modifications and/or additions may be incorporated into the various constructions and arrangements of parts without departing from the spirit or ambit of the invention.

The invention claimed is:

1. A cutting apparatus for cutting a flexible sheet material, the apparatus comprising:

a cutter body;

a rotatable first cutter blade operatively mounted to the cutter body so as to be rotatable about a cutter blade axis; and a second cutter blade operatively associated with the first cutter blade and mounted relative to the first cutter blade so as to define a cutting region between the first cutter blade and the second cutter blade, wherein in the cutting region a cutting operation of sheet material is in use effected as a result of cooperation between the first cutter blade and the second cutter blade, wherein the second cutter blade is operatively mounted to the cutter body via a pivot region which pivot region is axially offset from the cutting region in a direction along the cutter blade axis, such that cutting or shearing forces generated during a cutting operation cause the second cutter blade to be urged towards the first cutter blade, in turn, causing the second cutter blade to pivot at the pivot region.

2. A cutting apparatus according to claim 1, wherein the first cutter blade is a rotatable cutter disc.

3. A cutting apparatus according to claim 1, wherein the second cutter blade includes a cutting edge in the cutting region and a mounting arm which is operatively mounted in spaced relation to the cutting edge at the pivot region so that in use the cutting or shearing forces generated during the cutting operation tend to generate a torque which torque urges the cutting edge of the second cutter blade in the direction of the first cutter blade.

4. A cutting apparatus according to claim 3, wherein the cutter body is adapted for movement over a work surface, the first cutter blade having a peripheral edge portion adapted to cooperate with the second cutter blade to provide the cutting region, the cutter blade axis of the first cutter blade extending generally lateral with respect to a normal feed direction of sheet material to the cutting region and the direction of rotation of the peripheral edge portion through the cutting region is in the normal feed direction of sheet material being cut.

5. A cutting apparatus according to claim 4, wherein in use the tangential peripheral speed of the first cutter blade in the cutting region is not less than the speed of the feed of sheet material to the cutting region.

6. A cutting apparatus according to claim 1, including a drive adapted in use to cause rotation of the first cutter blade.

7. A cutting apparatus according to claim 6, wherein the drive includes a drive wheel operatively mounted to the cutter body, the drive wheel being operatively adapted to rotate as the cutter body is caused to move over a work surface in a direction opposite to a feed direction.

8. A cutting apparatus according to claim 7, wherein the drive wheel is operatively coupled to the first cutter blade via a transmission, the transmission adapted in use to cause the drive wheel and the first cutter blade to rotate in the same direction as the cutter body travels over the work surface.

9. A cutting apparatus according to claim 8, wherein the transmission includes a gear train.

* * * * *